US005747392A

United States Patent [19]

Xiao et al.

[11] Patent Number: 5,747,392

[45] Date of Patent: May 5, 1998

[54] STAIN RESISTANT, WATER REPELLANT, INTERPENETRATING POLYMER NETWORK COATING-TREATED TEXTILE FABRIC

[75] Inventors: Han Xiong Xiao, Bloomfield; Peng Geng, Detroit; Kurt C. Frisch, Grosse Ils, all of Mich.

[73] Assignee: Hi-Tex, Inc., Farmington Hills, Mich.

[21] Appl. No.: 752,429

[22] Filed: Nov. 19, 1996

[51] Int. Cl.[6] ..... B32B 27/02

[52] U.S. Cl. ..... 442/82; 442/71; 442/94; 442/124; 442/164; 442/168

[58] Field of Search ..... 442/64, 82, 94, 442/71, 124, 164, 168

[56] References Cited

U.S. PATENT DOCUMENTS

| | | |
|---|---|---|
| 3,238,010 | 3/1966 | Habib et al. . |
| 3,419,533 | 12/1968 | Dieterich . |
| 3,479,310 | 11/1969 | Dieterich et al. . |
| 4,027,062 | 5/1977 | Engelbrecht et al. . |
| 4,108,814 | 8/1978 | Reiff et al. . |
| 4,183,836 | 1/1980 | Wolfe, Jr. . |
| 4,203,883 | 5/1980 | Hangauer, Jr. . |
| 4,408,008 | 10/1983 | Markusch . |
| 4,507,413 | 3/1985 | Thoma et al. . |
| 4,507,430 | 3/1985 | Shimada et al. . |
| 4,594,286 | 6/1986 | McKinney et al. . |
| 4,598,120 | 7/1986 | Thoma et al. . |
| 4,833,006 | 5/1989 | McKinney et al. . |
| 4,889,765 | 12/1989 | Wallace . |
| 4,921,756 | 5/1990 | Tolbert et al. . |
| 4,996,099 | 2/1991 | Cooke et al. . |
| 5,091,243 | 2/1992 | Tolbert et al. . |
| 5,177,141 | 1/1993 | Thoma et al. . |
| 5,306,764 | 4/1994 | Chen . |

FOREIGN PATENT DOCUMENTS

| | | |
|---|---|---|
| 0525671 | 2/1993 | European Pat. Off. . |
| 3231062 | 2/1984 | Germany . |
| 3415920 | 11/1985 | Germany . |
| 3836030 | 5/1990 | Germany . |
| 1-97274 | 4/1989 | Japan . |
| 3195737 | 8/1991 | Japan . |
| 6-31845 | 2/1994 | Japan . |
| 6108365 | 4/1994 | Japan . |

OTHER PUBLICATIONS

John C. Tsirovasiles et al, The Use of Water–Borne Urethane Polymers In Fabric Coatings, J. Coated Fabrics (1986), Oct. 16, pp. 114–122.

Joseph W. Weinberg, Performance And Application Advantages of Waterborne Systems In The Automotive And Textile Industries, J. Industrial Fabrics (1986) 4(4), pp. 29–38.

*Primary Examiner*—Christopher Raimund

*Attorney, Agent, or Firm*—Brooks & Kushman P.C.

[57] ABSTRACT

Water repellant, stain resistant, weatherable, and transfer printable coated fabrics are provided by coating synthetic woven textile fabric with an IPN (interpenetrating polymer network)—containing aqueous coating which is composed of both acrylic and polyurethane lattices also including a crosslinker. Upon elevated temperature cure, the coating forms an interpenetrating polymer network and provides a non-leather like fabric with the hand and feel of high quality woven fabric with the ability to transmit water vapor while being virtually totally water repellant.

12 Claims, No Drawings

STAIN RESISTANT, WATER REPELLANT, INTERPENETRATING POLYMER NETWORK COATING-TREATED TEXTILE FABRIC

TECHNICAL FIELD

The present invention relates to treated textile fabrics, and more particularly to a method of preparing water-repellant, stain-resistant, interpenetrating polymer network coating-treated textile fabrics which display excellent hand and feel, and which may be used in traditional textile applications such as furniture upholstery. The treated fabrics are anti-microbial, and may be printed by transfer printing. The present invention further pertains to textile treating compositions useful for preparing such fabrics.

BACKGROUND OF THE INVENTION

Stain resistance, water repellency and resistance to microbial growth are important in many uses of textile materials. In restaurants, for example, table cloths and seating upholstery often lack stain resistance and are subject to rapid water penetration. These properties necessitate frequent cleaning and/or replacement of such items. Although one generally views microbial growth as associated with fibers of biologic origin such as cotton, wool, linen, and silk, in the field of marine use, the high relative humidity renders even synthetic polymer textiles such as polyesters and polyamides subject to microbial growth, which is also true of many other outdoor uses.

Water repellant textile fabrics may be made by various processes. The term "water repellant" as used herein means essentially impermeable to water, i.e. treated textile can support a considerable column of water without water penetration through the fabric. Such behavior is sometimes termed "water resistant." However, the last term generally implies a lesser degree of water repellency and further can be confused with the chemical use of "water resistant" to refer to coatings which are chemically stable to water or which will not be washed off by water. Hydrophobicizing topical treatments are incapable of providing the necessary degree of water repellency as that term is used herein.

Waxes and wax-like organic compounds have often been used to provide limited degrees of water repellency. For example, textile fabrics may first be scoured with a soap solution and then treated with a composition which may include zinc and calcium stearates as well as sodium soaps. The long chain carboxylic acid hydrophobic compounds provide a limited amount of water repellency. It is also possible to render fabrics liquid resistant by treating the fabric with commercially available silicone, for example poly(dimethylsiloxane). In tenting fabrics, use is commonly made of paraffin waxes, chlorinated paraffin waxes, and ethylene/vinyl acetate copolymer waxes. Typical of such formulations are those disclosed in U.S. Pat. No. 4,027,062, a wax-based organic solvent-borne system; and U.S. Pat. No. 4,833,006, which employs a wax-based, organic solvent-borne system further containing an unblocked polyisocyanate as an adhesion promoter. The use of the unblocked isocyanate is said to decrease the peeling or flaking off of the coating as compared to wax-based systems employing blocked isocyanate-terminated prepolymers as disclosed in U.S. Pat. No. 4,594,286. Such treated fabrics have a coarse, waxy hand and feel, exhibit little water vapor permeability, are not resistant to organic solvents, and importantly, cannot be transfer printed.

To overcome problems associated with water absorption and stain resistance, particularly in upholstery materials, resort has been made to synthetic leathers and polyvinylchloride (vinyl) coated fabrics. However, these fabrics do not have the hand or feel of cloth, and in general, are difficult and in many cases impossible to print economically. Moreover, although attempts have been made to render such materials water vapor permeable, these attempts have met with only very limited success, as evidenced by the failure of synthetic leather to displace real leather in high quality seating and footwear. For example, U.S. Pat. No. 4,507,413 discloses leather-like coatings prepared from an aqueous dispersion of a blocked, isocyanate-terminated polyurethane containing a water soluble thickener. The top coating is coated onto a release paper, cured with diamine, and then bonded with the aid of a bonding coat to a fabric support. Following removal of the release paper, a grained, leather-like coating is obtained. In U.S. Pat. No. 5,177,141, similar coatings are disclosed which, in addition, require a water immiscible solvent to be dispersed with the polyurethane, and further requires the presence of a hydrophilic polyisocyanate to promote adhesion to the textile substrate. The presence of the water-immiscible solvent produces a pore-containing material by evaporative coagulation, leading to high water vapor permeability.

Although the treating and coating methods discussed previously may assist in rendering the fabric partially liquid and/or stain resistant, the leather-like appearance of fabrics coated as disclosed by U.S. Pat. Nos. 4,507,413 and 5,177,141 is not desired in many fabric applications. Despite their higher water vapor permeability as compared to earlier generation synthetic leathers, such products are still uncomfortable in many seating upholstery applications. Furthermore, fabrics treated or coated with wax-like polymer or wax emulsions cannot be satisfactorily printed. The treated liquid resistant fabrics may refuse to accept or become incompatible with the application of color dyes. The polymeric coated liquid resistant fabrics cannot be transfer printed because the heat required in the printing process generally causes the polymeric coating to melt or deform. Thus, if a fabric with a particular design or logo is required, the textile fabric must be printed first by traditional methods, following which it may be treated or polymer coated. However, the polymer coating generally obscures the design due to its thickness and opacity, even when non-pigmented vinyl, for example, is used.

Applications of fluorochemicals such as the well known SCOTCHGUARD™ and similar compounds also may confer a limited degree of both water resistance and stain resistance, as discussed previously. However, for optimal water repellency, it has proven necessary to coat fabrics with thick polymeric coatings which completely destroy the hand and feel of the fabric. Examples include vinyl boat covers, where the fabric backing is rendered water resistant by application of considerable quantities of polyvinylchloride latex or the thermoforming of a polyvinyl film onto the fabric. The fabric no longer has the hand and feel of fabric, but is plastic-like. Application of polyurethane films in the melt has also been practiced, with similar results. However, unless aliphatic isocyanate-based polyurethanes are utilized, the coated fabric will rapidly weather.

In many industrial, institutional, and commercial applications, severe flame retardant properties are required. Upholstered furniture must often pass the stringent so-called Boston chair or U.K. Crib 5 tests. In these tests, a bag with a weighed quantity of dry newspaper or a crib of wood of specified weight is placed onto the chair and ignited. As the seating cushions, whether of the enclosed spring type with cotton or polyester cushioning, or of the more prevalent polyurethane foam cushioning, are themselves flammable, the cushions in general necessitate covering with a flame barrier of woven fiberglass or the like, then covering with printed upholstery fabric. Fiberglass flame barriers tend to make the cushioning less comfortable as well as creating the potential for penetration of irritating glass fibers into the occupant.

Coatings of polyurethanes or polyurethane ureas have been disclosed in numerous patents and publications. However, the majority of these coatings, such as those previously described, produce fabrics whose hand and feel is not acceptable, i.e. are synthetic leather-like in appearance. Moreover, in producing non-leather-like fabrics coated with polyurethane, it is generally necessary to dissolve the polyurethane into a solvent, and apply this solution to the fabric. Polyurethane lattices, in general, have not been used to provide a fabric with a soft feel, because the prepolymer viscosity of polyurethanes necessary to provide soft coatings is so high that dispersions cannot be prepared. Thus, solvent-borne polyurethanes have been used. Unfortunately, it is increasing difficult to utilize solvent-borne coatings of any kind in both industrial and domestic applications due to pollution laws. Examples of the foregoing coatings are disclosed in Japanese patent JP 06108365 A2, "Moisture Permeable Water-Resistant Polyurethane-Coated Fabrics And Their Manufacture"; U.S. Pat. No. 5,306,764, "Water Dispersable Polyurethane-Urea Coatings And Their Preparation"; Japanese patent JP 06031845, "Manufacture of Water-Resistant Moisture-Permeable Laminated Fabrics"; European published application EP 525671 A1, "Water-Borne Resin Compositions and Automobile Interior Fabrics Coated With Same"; Japanese patent 03-195737 A2, "Aqueous Polyurethane Acrylate Dispersions"; German patent DE 3 836 030 A1, "Aqueous Polyurethane Dispersions For Moisture-Permeable Coatings"; U.S. Pat. No. 4,889,765, "Ink-Receptive, Water-Based Coatings"; Japanese patent JP 01097274 A2, "Moisture-Permeable Waterproof Sheets"; John C. Tsirovasiles et al., "The Use of Water-Borne Urethane Polymers in Fabric Coatings", J. COATED FABRICS (1986), October 16, pp. 114–22; Weinberg, Joseph W., "Performance and Application Advantages of Water-Borne Systems In Automotive And Textile Industries", J. INDUSTRIAL FABRICS (1986) 4(4), pp. 29–38; German patent DE 34 15 920 A1, "Aqueous Dispersions For Coating of Textiles"; and German patent DE 323 10 62 A1, "Aqueous Dispersions of Reactive Polyurethanes for Coatings".

The foregoing references all produce fabrics with severe deficiencies in numerous areas. The most severe deficiency in many of these fabrics is the inability to be transfer-printed. Transfer printing requires elevated temperatures at which the bulk of these coatings melt and adhere to the transfer printing drum. The inability to be transfer-printed requires that the fabrics be printed by conventional textile printing methods. However, the use of such methods is impractical in short runs of less than, for example, 10,000 meters of material. Thus, it is impossible to economically produce unique designs in short runs of fabric.

It would be desirable to produce a water-borne coating system which may be used to coat textile fabrics to render them water-repellant and stain-resistant, and yet be transfer printable, all without destroying the normal hand and feel of the fabric. The fabrics furthermore should be resistant to weathering and exposure to light. Such fabrics can be used in outdoor applications where previous fabrics have been limited due to the relatively fast degradation of the coatings in the presence of sunlight.

SUMMARY OF THE INVENTION

The present invention provides a water-repellant, stain-resistant, transfer printable, anti-microbial fabric that is durable enough to withstand the high temperatures required for transfer printing, and yet which retains the hand and feel of fabric rather than being leather-like or plastic-like. Furthermore, the fabrics are weather-resistant, and can be used in outdoor applications such as sun awnings, lawn and patio umbrellas, boat covers, and the like. The fabrics are prepared by treating a synthetic fiber textile with a unique polyurethane and acrylic latex which cures on the fabric to form an interpenetrating polymer network. Fluorochemicals in the coating provide an excellent level of stain protection while yet making transfer printing possible. The interpenetrating polymer network attained on curing renders the coating extremely durable, as well as weather-resistant.

BEST MODES FOR CARRYING OUT THE INVENTION

The subject coatings are aqueous dispersions which may be applied to synthetic textile fabrics in one or more passes to provide treated fabrics with the physical properties desired. By the term "synthetic fabric" is meant a fabric containing at least 40 weight percent of synthetic polymer fibers, i.e. nylon fibers, polyester fibers, and the like. The fibers useful in the present invention are preferably those which can be transfer-printed. The textile fabrics are woven. Non-woven, i.e. random mat or spun-bonded non-wovens are not contemplated for use herein. Preferred synthetic textile fabrics are polyester fabrics and nylon fabrics.

The aqueous dispersions comprise minimally four components, all in dispersed form. These four components are a urethane latex, an acrylic latex, a crosslinking resin, and an organic fluorochemical. The above components are applied to the fabric as a dispersion and dried and cured at elevated temperature, preferably at a temperature of 300°–358° F. (149° C.–181° C.) for 1 to 5 minutes. The cured coatings are water-resistant, stain-resistant, weather-resistant, can be transfer-printed, yet look and feel like traditional high quality textile materials. While not wishing to be bound to any particular theory, it is believed that the physical properties of the subject fabrics are due to the use of the inventive coatings which are the result of a combination of dispersed phase particle coalescence and cross-linked structure which produces an interpenetrating polymer network (IPN) which also permeates the inter-yarn spacings and may at least partially coat the individual fibers themselves.

The urethane latex must be compatible with the acrylic latex to prepare the coatings. It should be noted that no urethane acrylate is required, although its presence is not excluded. Rather, the urethane latex and acrylic latex are discrete polymers prior to cure. By "acrylic latex compatible" is meant a urethane latex which, when mixed with the acrylic latex, produces a dispersion which is storage stable in the sense that resin viscosity does not increase substantially to the point where it is unusable after several days of storage at 25°–35° C., and which does not gel, coagulate, or flocculate when mixed. A simple test for compatibility is to mix together the desired components at 25° C. and observe the dispersion for gelation, coagulation, or flocculation. If none has occurred within a few minutes, then the dispersion is bottled and stored in a warm oven at 35° C. for several days. If no severe increase in viscosity has occurred during this time, and no significant amount of gelation, coagulation, or flocculation, then the urethane latex is an acrylic-compatible urethane latex. Anionic polyurethane lattices are preferred.

Anionic polyurethane lattices are commercially available. Such lattices prepared by reacting an isocyanate component with a polyol component containing dimethylolpropionic acid (DMPA) in such a way that anionic stabilizing groups are incorporated into the resultant prepolymer. The isocyanate-terminated prepolymer is then neutralized with an organic base dispersed into water and chain extended with an amino-functional chain extender, preferably a diamine. The anionic stabilizing groups are necessary in order to prepare a uniform and stable dispersion. It is of paramount importance that the dispersed phase be capable of coalescing either upon coating of a substrate or at an elevated temperature cure.

Methods of preparation of polyurethane lattices are now well known, as illustrated by U.S. Pat. Nos. 3,479,310; 4,183,836; 4,408,008; and 4,203,883, all of which are herein incorporated by reference. The preparation generally involves the reaction of a polyether diol in admixture with a dispersing aid with a stoichiometric excess of isocyanate, followed by neutralization with base, dispersion in water, chain extension with diamines, and conversion of the dispersing group to anionic form.

Modest to high molecular weight polyether diols generally comprise a major portion, i.e. greater than 50 weight percent, preferably greater than 80 weight percent, of the polyol component used to prepare the isocyanate-terminated prepolymer. The polyether diols are preferably poly (oxypropylene) glycols, and preferably have molecular weights between about 1000 Da and 8000 Da. By the term "polyol component" is meant that portion of the isocyanate-reactive ingredients which is exclusively hydroxyl-functional and is used to form the prepolymer, other than reactive dispersing aids. Thus, the polyol component may include minor amounts of hard-segment from short chain diols, for example, but not limited to: ethylene glycol, 1,3-propylene glycol, 1,4-butanediol, 1,6-hexanediol, 1,4-cyclohexanediol, 1,4-cyclohexanedimethanol, 4,4'-dihydroxybihenyl, neopentyl glycol, 2,2,4-trimethylpentanediol, and polyoxyalkylene oligomers with molecular weights of less than about 300. Mixtures of these low molecular weight species may also be used. The polyol component may further include a minor amount of other high molecular weight diols such as polyester diols, polytetramethylene ether glycols (PTMEG), and the like. Molecular weights herein are number average molecular weights in Daltons (Da) unless otherwise specified.

The isocyanates useful in the preparation of the subject polyurethane dispersions may, in general, be any organic di- or polyisocyanate, whether aliphatic or aromatic. However, preferred isocyanates are the commercially available isocyanates toluene diisocyanate (TDI), methylenediphenylene diisocyanate (MDI), and their saturated analogs. Toluene diisocyanate is generally used as an 80:20 mixture of 2,4- and 2,6-TDI, although other mixtures such as the commercially available 65:35 mixture as well as the pure isomers are useful as well. Methylenediphenylene diisocyanate may also be used as a mixture of 2,4'-, 2,2'-, and 4,4'-MDI isomers. A wide variety of isomeric mixtures are commercially available. However, most preferable is 4,4'-MDI or this isomer containing minor amounts of the 2,4'- and 2,2'-isomers.

Preferred aliphatic isocyanates are the alkylene diisocyanates such as 1,6-diisocyanatohexane, 1,8-diisocyanatooctane, and linear diisocyanates having interspersed heteroatoms in the alkylene residue, such as bis(3-isocyanatopropyl)ether. More preferred aliphatic isocyanates are the various cycloaliphatic isocyanates such as those derived from hydrogenated aryldiamines such as toluene diamine and methylene-dianiline. Examples are 1-methyl-2,4-diisocyanatocyclohexane and 1-methyl-2,6-diisocyanatocyclohexane; bis(4-isocyanatocyclohexyl) methane and the isomers thereof; 1,2-, 1,3-, and 1,4-bis(2-(2-isocyanatopropyl))benzene; and isophorone diisocyanate.

Modified isocyanates based on TDI and MDI are also useful, and many are commercially available. For example, small quantities, generally less than one mole of an aliphatic glycol or modest molecular weight polyoxyalkylene glycol or triol may be reacted with 2 moles of diisocyanate to form a urethane modified isocyanate. Also suitable are the well known carbodimide, allophanate, uretonimine, biuret, and urea modified isocyanates based on MDI or TDI. Mixtures of diisocyanates and modified diisocyanates may be used as well.

The isocyanate should be present in an amount sufficient to ensure isocyanate-termination of the prepolymer. The ratio of isocyanate groups to isocyanate-reactive groups contained in the polyol component, dispersing aid component, and any other reactive components present during prepolymer formation should, in general, range from 1.1 to 4, preferably 1.5 to 2.5, and more preferably 1.5 to 2.2 on an equivalent basis. The resulting prepolymers should desirably have isocyanate group (NCO) contents of between 1 and 8 weight percent, preferably 1 to 5 weight percent, based on the weight of the prepolymer. Prepolymer formation may be conducted neat or in non-reactive solvent, generally an aprotic water soluble or water miscible solvent such as dimethylformamide, N-methylpyrrolidone, tetrahydrofuran, methylethylketone, acetone, and the like. For low VOC lattices, the solvent should be removed prior to or after dispersion in water. Reaction temperatures below 150° C., preferably between 50 ° and 130° C. are suitable. The reaction may be catalyzed by known catalysts, for example tin(II) octoate, dibutyltin dilaurate, dibutyltin diacetate, and the like, in amounts of 0.001 to about 0.1 weight percent, preferably 0.005 to 0.05 weight percent based on the weight of the prepolymer. Other catalysts are suitable as well.

For a stable dispersion, the prepolymer should contain one or more dispersing aids. The dispersing aid component may comprise a single dispersing aid or a mixture of one or more compatible dispersing aids, at least one of which must be reactive with the isocyanate component or the polyol component, preferably the former, and is considered when calculating the equivalent ratio of NCO-groups to NCO-reactive groups. In general, for example, the use of both cationic and anionic group-containing dispersing aids is not recommended, as these groups may inter-react, resulting in flocculation, coagulation, or precipitation of the prepolymer from the dispersion. Anionic and hydrophilic diols or diamines are preferred. Examples of suitable anionic diols, preferably containing carboxylate or sulfonic acid groups, as well as cationic quaternary nitrogen groups or sulfonium groups, are disclosed in U.S. Pat. Nos. 3,479,310; 4,108,814; and 3,419,533. Preferred, however, are hydroxycarboxylic acids having the formula $(HO)_xR(COOH)_y$ where R represents an organic residue and x and y both represent values of 1–3. Examples include citric and tartaric acid. However, the preferred acid-containing diols are α,α-dimethylol-alkanoic acids such as α,α-dimethylolacetic acid, and in particular, α,α-dimethylolpropionic acid. Polymers containing ionic groups or latent ionic groups and having isocyanate-reactive groups are also suitable. Examples include vinyl copolymers containing residues of acrylic acid and hydroxyethylacrylate or other hydroxyl-functional vinyl monomers.

Hydrophilic dispersing aids, as defined herein, are those non-ionic groups which impart hydrophilic character. Such groups may include oligomeric polyoxymethylene groups or preferably, polyoxyethylene groups. Particularly preferred are monofunctional polyoxyethylene monols or copolymer monols based on ethylene oxide and propylene oxide where a major portion of the oxyalkylene moieties are oxyethylene such that the monol as a whole is hydrophilic. Other hydrophilic, non-ionic polymers containing isocyanate reactive groups are useful as well. When hydrophilic, monofunctional dispersing aids are utilized, the isocyanate component may advantageously contain higher functional isocyanates such as the polymethylene polyphenylene polyisocyanates with functionalities between 2 and 2.4. Alternatively, the amount of diisocyanate may be increased and minor quantities of low molecular weight, isocyanate reactive, polyfunctional species such as glycerine, trimethylol-propane, diethanolamine, triethanolamine and the like, generally considered in polyurethane chemistry as cross-linking agents, may be added to counteract the chain blocking effect of monofunctional monols. However, addition of polyfunctional species is known to sacrifice some properties.

The dispersing aid component, containing one or more dispersing aids, may be added to the prepolymer-forming ingredients during prepolymer formation, thus being randomly incorporated into the prepolymer molecular structure, or may be added following the reaction of the di-or polyisocyanate with the polyol component. Cross-linking agents, as described previously, may also be added simultaneously or subsequently. Alternatively, when two or more dispersing aids are present in the dispersing aid component, one dispersing aid or a portion of the mixture of two or more dispersing aids may be added during prepolymer formation with the remainder added following prepolymer formation. Regardless of when the dispersing aids are added, the resulting dispersing aid-containing prepolymer should retain isocyanate-reactive functionality.

The prepolymer thus formed may be dispersed in water by any known method, for example by adding water with stirring until phase inversion occurs, but preferably by adding the prepolymer, either neat or dissolved in solvent, to water with vigorous stirring.

Either before or after the prepolymer has been dispersed, latent cationic or anionic groups, preferably anionic dispersing groups, are advantageously converted to the corresponding anion or cation, for example, conversion of carboxylic acid groups to carboxylate groups. Conversion of carboxylic acid groups to carboxylate groups may be accomplished by addition of a neutralizing agent, for example a tertiary amine such as triethylamine.

Following preparation of the prepolymer dispersion and conversion of all or a portion of latent ionic groups to ionic groups, the chain extender is added to the dispersion. The chain extender may be one of the known glycol chain extenders, but is preferably an amine-functional or hydroxylamine-functional chain extender. The chain extender may be added to the water before, during or after dispersing the prepolymer. If the chain extender is added after dispersing the prepolymer, then it should be added before the prepolymer has an opportunity to significantly react with water, normally within 30 minutes, preferably 15 minutes.

The amine chain extender is preferably a polyfunctional amine or a mixture of polyfunctional amines. The average functionality of the amine, i.e., the number of amine nitrogens per molecule, may be between about 1.8 and 6.0, preferably between about 2.0 and 4, and most preferably between about 2.0 and 3. The desired functionalities can be obtained by using mixture of polyamines. For example, a functionality of 2.5 can be achieved by using equimolar mixtures of diamines and triamines. A functionality of 3.0 can be achieved either by using:

(1) triamines, (2) equimolar mixtures of diamines and tetramines, (3) mixtures of 1 and 2, or (4) any other suitable mixtures.

These other suitable mixtures for obtaining the desired functionalities will be readily apparent to those of ordinary skill in the art.

Suitable amines are essentially hydrocarbon polyamines containing 2 to 6 amine groups which have isocyanate-reactive hydrogens according to the Zerewitinoff test, e.g., primary or secondary amine groups. The polyamines are generally aromatic, aliphatic or alicyclic amines and contain between about 1 to 30 carbon atoms, preferably about 2 to 15 carbon atoms, and most preferably about 2 to 10 carbon atoms. These polyamines may contain additional substituents provided that they are not as reactive with isocyanate groups as the primary or secondary amines. Examples of polyamines for use in the present invention include the amines listed as low molecular compounds containing at least two isocyanate-reactive amino hydrogens, and also diethylene triamine, triethylene tetramine, tetraethylene pentamine, pentaethylene hexamine, N,N,N-tris-(2-aminoethyl) -amine, N-(2-piperazinoethyl)ethylene diamine, N,N'-bis-(2-aminoethyl)-piperazine, N,N,N'-tris-(2-aminoethyl)-ethylene diamine, N-[N-(2-aminoethyl)-2-aminoethyl]-N'-(2-piperazinoethyl)-ethylene diamine, N-(2-amino-ethylene-N'-(2-piperazinoethyl)amine, N,N-bis-(2-piperazinoethyl)-amine, polyethylene imines, iminobispropyl-amine, guanidine, melamine, N-(2-aminoethyl)-1,3-propane diamine,3,3'diaminobenzidine,2,4,6-triaminopyrimidine, polyoxypropylene amines, tetrapropylenepentamine, tripropylenetetramine, N,N-bis-(6-aminohexyl)amine, N,N'-bis-(3-aminopropyl)-ethylene diamine and 2,4-bis-(4'-aminobenzyl)-aniline. Preferred polyamines are 1-amino-3-aminomethyl-3,5,5-trimethylcyclohexane (isophorone diamine or IPDA), bis-(4-aminocyclohexyl)methane, bis-(4-amino-3-methylcyclohexyl)methane, 1,6-diaminohexane, ethylene diamine, diethylene triamine, triethylene tetramine, tetraethylene pentamine and pentaethylene hexamine.

The amount of polyfunctional amine to be used in accordance with the present invention is dependent upon the number of terminal isocyanate groups in the prepolymer. Generally, the ratio of terminal isocyanate groups of the prepolymer to the amino hydrogens of the polyfunctional amine is between about 1.0:0.6 and 1.0:1.1, preferably between about 1.0:0.8 and 1.0:0.98 on an equivalent basis. Lesser amounts of polyfunctional amine will allow for undesired reaction of the isocyanate groups with water, while an undue excess may lead to products with low molecular weight and less than the desired amount of cross-linking, when cross-linking is desired. For the purposes of these ratios, a primary amine group is considered to have one amino hydrogen. For example, ethylene diamine has two equivalents of amino hydrogens and diethylene triamine has three equivalents.

The reaction between the dispersed prepolymer and the polyamine is conducted at temperatures from about 5° to 90° C., preferably from about 20° to 80° C., and most preferably from about 30° to 40° C. The reaction conditions are normally maintained until the isocyanate groups are essentially completely reacted. In order to reduce the presence of localized concentration gradients, the polyamine is preferably added slowly or in increments to the dispersed prepolymer which is normally agitated to ensure complete mixing of the polyamine throughout the aqueous medium. The polyamine may be added to the aqueous medium neat or it may be dissolved or dispersed in water or an organic solvent. Suitable organic solvents are those previously described for use in preparing the isocyanate-terminated prepolymer.

The final product is a stable, aqueous dispersion of colloidally-sized particles of urea-urethanes. The particle size is generally below about 1.0 micron, and preferably between about 0.001 to 0.5 micron. The average particle size should be less than about 0.5 micron, and preferably between 0.01 to 0.3 micron. The small particle size enhances the stability of the dispersed particles and also leads to the production of highly coalesced films.

It is to be understood that the methods of preparing the polyurethane dispersions of the present invention are exemplary, and other methods known to those skilled in the art may be used as well without departing from the spirit of the invention. Suitable methods, for example, are disclosed in U.S. Pat. Nos. 4,408,008; 4,507,430; 3,479,310; 4,183,836; and 3,238,010, which are herein incorporated by reference.

The acrylic latex comprises a dispersion of polymers and/or copolymers of acrylic or acrylate functional monomers, optionally copolymerized with other ethylenically unsaturated monomers. The nature of the monomers from which the polymer particles of the copolymer latex may be formed may be adjusted by one skilled in the art to provide the properties desired of the coated fabric. Preferably, the latex particles are acrylate copolymers, i.e. copolymers formed from lower alkyl acrylates such as methylacrylate, ethylacrylate, butylacrylate, methylmethacrylate, and the like, as well as additional copolymerizable monomers such as vinyl acetate, acrylonitrile, styrene, acrylic acid, acrylamide, N-methylacrylamide, and urethane acrylates. The presence of crosslinkable groups such as acrylamide and N-methylacrylamide along the polymer backbone is preferred. Terpolymers of styrene, methylacrylate, and ethylacrylate are very suitable. Examples are WRL1084, a styrene, methylacrylate, ethylacrylate copolymer containing N-methylacrylamide in the polymer backbone available from B.F. Goodrich, and Hycar® 1402 from the same source. The copolymer lattices are available in varying solids contents, for example, from 30 to 60 weight percent, which are then added to formulating water to provide the desired solids content in the coating composition. It is sometimes advantageous that the particles constituting the acrylic latex solids should have a glass transition temperature less than 50° C., preferably in the range of 10° to 35° C., most preferably about 20° C. Copolymers having glass transition temperatures appreciably below 10° C. may not present optimal stain resistance. Preferably, the surfactant content of the latex is as low as possible to provide for good water repellency and water resistance.

The antimicrobial agent is present in an antimicrobially-effective amount, and comprises preferably about 0.25% to about 4% by weight of the aqueous coating composition more preferably 0.40 to about 2 weight percent, and most preferably 0.40 to 1 weight percent. By "antimicrobial agent" is meant any substance or combination of substances that kills or prevents the growth of a microorganism, and includes antibiotics, antifungal, antiviral and antialgal agents. The preferred antimicrobial agents are ULTRA FRESH™, available from Thomas Research, and INTERSEPT™, available from Interface Research Corporation. Other anti-microbials, particularly fungicides, may be used. Examples are various tin compounds, particularly trial-kyltin compounds such as tributyl tin oxide and tributyl tin acetate, copper compounds such as copper 8-quinolinolate, metal complexes of dehydroabietyl amine and 8-hydroxyquinolinium2-ethylhexoate, copper naphthenate, copper oleate, and organosilicon quarternary ammonium compounds.

The fluorochemical textile treating agent comprises a substantial part of the primary coating composition, for example, higher than 50 weight percent based on solids, but comprises a minor portion of the back coat, i.e., preferably 10% by weight on the same basis. The fluorochemicals provide water and stain resistance and may comprise unbranded generic fluoropolymers. Commercially available fluorochemical compositions such as Zonyl® 8412 and Zonyl® RN available from Ciba-Geigy, SCOTCHGUARD™ FC 255, SCOTCHGUARD™ FC 214–230, available from 3M, and TEFLON® RN, TEFLON® 8070, and TEFLON™ 8787, available from Dupont, are preferred. TEFLON™ 8070 and Zonyl® 8412 are the most preferred fluorochemicals. It is noteworthy that the amount of fluorochemical treating agent used is considerably higher than amounts traditionally used for treating upholstery fabric to render it stain resistant, or to provide a minimal amount of hydrophobicity.

Preferred cross-linking resins are the various melamine/formaldehyde and phenol/formaldehyde resins and their variants, particularly CYREZ® 933, a product of the American Cyanamid Company. Other phenol, melamine, urea, and dicyandiamide based formaldehyde resins are available commercially, for example, from the Borden Chemical Company. Preferably, melamine/formaldehyde resin in the amount of 0.1 to about 5.0 weight percent, preferably about 0.25 to 1 weight percent based on the weight of the aqueous treating composition is used. Other crosslinkable resins such as oligomeric unsaturated polyesters, mixtures of polyacrylic acid and polyols, e.g. polyvinylalcohol, and epoxy resins may also be used, together with any necessary catalysts to ensure crosslinking during the oven drying cycle.

The liquid and stain resistant, antimicrobial, printed fabric of the present invention retains its natural "hand" or texture and is therefore aesthetically attractive. The fabric of the present invention is also durable, easy to handle and economical to produce. Of special note is the ability to treat long runs of fabric which is undyed or dyed to a uniform background color, which may be later transfer printed with a suitable design or logo after coating. Transfer printing is uniquely adapted to short runs. The combination of these benefits allows stain resistant, water resistant fabrics of varied patterns to be commercially viable, even in short runs. When fabrics are printed prior to coating, most mills require minimal runs of 2000 yds (1900 m) or more, rendering small runs of printed, then coated fabric, commercially unfeasible. Furthermore, the fabric of the present invention meets various flame retardant codes for the upholstery industry.

The fabrics to be coated by the subject process include many textile materials, in particular polyesters, polyacrylics, and polyamides (nylons), including blends of these fibers with each other and with other fibers, for example, natural fibers, such as cotton. When the base fabric comprises a corespun yarn containing fiberglass overwrapped with a synthetic polymeric fiber, the treated fabric is suitable for replacing the flame barrier and printed fabric in upholstery and other applications, and is further suitable for highly flame retardant commercial and industrial uses, for example, as drapery material. Examples of such corespun yarns may be found in U.S. Pat. Nos. 4,921,756; 4,996,099 and 5,091,243, herein incorporated by reference.

The treating process of the subject invention involves first coating the fabric with a coating composition which, in its most basic nature, comprises a low solids latex containing both polyurethane and acrylic lattices and a major portion of fluorochemical treating agent, and optionally but preferably, one or more microbicidides and/or mildewcides. The nature of the coating bath and its composition is such that the fabric is thoroughly treated, the primer coating composition covering equally well both sides of the fabric as well as the interstitial spaces within the fabric. The fabric is then oven dried at elevated temperatures, for example, from 250° F. to 350° F. (121° C. to 177° C.). The fabric thusly treated is mildew resistant and substantially water repellant. In addition, its tensile and tear strengths are markedly improved. Yet, the fabric is very difficult to distinguish from untreated fabric by hand, feel, texture, or ease of handling.

Although the process described above creates a unique new textile material, the material is not completely water repellant. Inspection of the fabric against a light reveals multitudinous "pinholes" which may ultimately allow water to pass through the fabric. To render the fabric fully water repellant, one or more additional coating steps may be necessary, depending on the degree of water repellancy desired. Both these additional steps may be the same, and involve the application of the high solids polyurethane and polyacrylic polymeric latex, to one side of the fabric. The latex, with the consistency of wallpaper paste or high solids wood glue, is rolled, sprayed, or otherwise applied to the fabric which then passes under a knife blade, doctor blade, or roller which essentially contacts the textile surface, leaving a thin coating of approximately 1.5 oz/yd$^2$ (50 g/m$^2$) of material. The coated fabric is then oven dried at 250° F. to 350° F. (121° C. to 277° C.).

The resulting fabric still retains excellent hand and feel, although being somewhat less drapeable than the virgin textile material. Inspection against a light shows very few pinholes, which application of a somewhat thicker coating may further reduce. However, even with the relatively few pinholes, the fabric is virtually completely water repellant able to support a considerable column of water without leakage. If further water repellant is required, this second treatment may be repeated.

The first step in the process of treating fabric in accordance with the present invention involves the application of a penetrating topical coating to the fabric followed by oven drying. The topical coating formulation, hereinafter referred to as the primary coating or coating composition, is an aqueous bath containing from 5 weight percent to about 40 weight percent solids, preferably from 5 weight percent to 25 weight percent solids, of which approximately 4 weight percent to 20 weight percent based on solids represent latex solids. This primary, topical treatment bath, contains minimally the following components: a urethane latex; an acrylic latex; a fluorochemical; and additives such as a fungicide. In preferred embodiments, the primary bath may further include a crosslinking agent, a fire retardant and/or smoke suppressant, and other additives and auxiliaries such as dispersants, thickeners, dyes, pigments, ultraviolet light stabilizers, and the like.

The fabrics produced by the subject process are, in general, flame retardant. However, it would not depart from the spirit of the invention to add additional flame retardants and/or smoke suppressants. Suitable flame retardants are known to those skilled in the art of fabric finishing, and include, for example, cyclic phosphonate esters such as Antiblaze 19T available from Mobil Chemical Co, zinc borate, and other known flame retardants.

The fabric to be coated may be drawn through the treating bath by any convenient method, or the treatment solution may be sprayed or rolled onto the fabric. Preferably, the fabric, previously scoured to remove textile yarn finishes, soaps, etc., is drawn through the bath, as the topical treatment of the first treating step should uniformly coat both sides of the textile as well as its interior. For this purpose, the first treatment, which may be termed the "primer coat" is generally formulated at lower solids content and hence less viscosity than the second coat. The second coat is preferably applied to the non-printed side of the fabric and may also be referred to as a back coat. The fabric, after being drawn through the bath, may be passed through nips or nip rollers to facilitate more thorough penetration of the treating composition into the fabric and/or to adjust the amount of treatment composition by the fabric. By such or other equivalent means, the pickup is adjusted to provide from 5 to 200 weight percent pickup relative to the weight of the untreated fabric, more preferably from 5 to 90 weight percent, and most preferably from 8 to 20 weight percent, based on solids. The treated fabric is then passed through an oven maintained at an elevated temperature, preferably from 250° F. to 350° F. (121° C. to 177° C.) for a period sufficient to dry the applied coating, and, if the first treatment step is not to be followed by additional treatment, to perform any necessary cross-linking reaction with interpenetrating network (IPN) of the components of the treatment composition. Generally, a period of from 1 to 8 minutes, preferably about 2 minutes at 325° F. (163° C.) is sufficient.

For complete water repellency, one or more subsequent secondary treatments are utilized. The secondary treatment compositions utilized for the second and subsequent treatments are different from those of the primary treatment, although the latter treatment may be repeated as well. The second and subsequent treatments are designed to increase stain resistance and also to render the fabric virtually totally water repellant and unpenetrable. Like the fabrics which receive only one or more primary treatments, the fabrics obtained after treatment with the secondary, or "back coating" treatment composition are able to be transfer printed without difficulty.

The second treatment composition also comprises a polyurethane latex, an acrylic latex, one or more microbicides, and a fluorochemical textile treatment agent. However, in contrast to the primary treatment bath, the amount of latex solids is considerably higher, and the amount of fluorochemical correspondingly lower. The treatment composition should contain from 30 to 60 weight percent solids, preferably 40 to 50 weight percent, and most preferably about 45 to 52 weight percent. Thickeners may be necessary to adjust the rheological properties of the secondary treatment composition. Such thickeners are well known, and include water soluble, generally high molecular weight natural and synthetic materials, particularly the latter. Examples of natural thickeners include the various water soluble gums such as gum acacia, gum tragacanth guar gum, and the like. More preferred are the chemically modified celluloses and starches, such as methylcellulose, hydroxymethylcellulose, propylcellulose, and the like. Most preferred are high molecular weight synthetic polymers such as polyacrylic acid; copolymers of acrylic acid with minor amounts of copolymerizable monomers such as methyl acrylate, methacrylic acid, acrylonitrile, vinylacetate, and the like, as well as the salts of these compounds with alkali metal ions or ammonium ions; polyvinylalcohol and partially hydrolyzed polyvinylacetate; polyacrylamide; polyoxyethylene glycol; and the so-called associative thickeners such as the long chain alkylene oxide capped polyoxyethylene glycols and polyols or their copolymer polyoxyethylene/polyoxypropylene analogues. The length of the carbon chain of the long chain alkylene oxide in associative thickeners has a great effect on the thickening efficiency, with alkylene residues of 8–30 carbon atoms, preferably 14–24 carbon atoms having great thickening efficiency. The thickener may be used in amounts up to 4 weight percent, preferably about 2 weight percent or less. In contrast to the urethane and acrylic lattices, in which the solids are dispersed, the thickener solids are water soluble in the amounts used.

The remaining ingredients are similar to those of the first treatment composition, and include fluorochemical textile treating agent, one or more microbicides, for example, ULTRAFRESH™ DM-50 and ULTRAFRESH™ UF-40 biocides available from Thompson Research Corporation. The preferred compositions further contain zinc ammonium carbonate; calcium stearate dispersion; zinc borate; melamine/formaldehyde resin, preferably CYREZ 933; and sodium polyacrylate thickener solids, supplied as a 14 to 20 weight percent solids solution.

Fire retardants which are dispersible may be added to the secondary treatment composition in the place of or in addition to those previously described. An example is Caliban P-44, containing decabromodiphenyloxide and antimony oxide available from White Chemical Company. A suitable smoke suppressant is zinc borate, which may advantageously be used in the amount of 2 weight percent based on solids.

The resulting composition is considerably more viscous than the first treatment composition, and has a consistency similar to that of PVA wood glue or wallpaper paste. Unlike the primary, topical treatment, which is applied to both sides of the fabric by virtue of immersion in a bath, the second and subsequent treatments are applied to one side of the fabric only, the side opposite to that to be optionally transfer printed.

The amount of the secondary treatment applied may vary. Preferably, a doctor blade or knife edge is adjusted to touch or nearly touch the fabric surface as the fabric, coated with the composition, passes by. Although the coating may be as much as about 1 mm thick above the fabric, it is preferred that the wet surface of the coating be at substantially the height of the uppermost yarns of the fabric. When subsequently dried, the thickness of the coating will, of course, be considerably reduced.

It is of great importance that the primary treatment precede the secondary or subsequent treatment(s). The primary treatment interferes with the penetration of the secondary treatment into the fabric, and thus limits the amount of secondary treatment composition which the fabric can obtain with a given knife blade setting. The inability of the secondary treatment composition to substantially penetrate into the fabric assists in maintaining the hand and feel of the fabric, which otherwise would be stiff and boardy.

Following the secondary treatment, the fabric again is oven dried, at temperatures from 250° F. to 350° F. (121° C. to 177° C.), preferably 300 to 350° F. (149° C. to 177° C.). As a result of the primary, secondary, and any subsequent treatments, the weight of the finished fabric will have increased by from 5% to 200%, preferably from 10% to about 90%, and particularly from 8% to 20%.

Thus, the coating composition of the subject invention may be further described as a four component waterborne IPN (interpenetrating polymer network) coating for fabrics, prepared by using acrylic lattices, anionic urethane dispersions, melamine resins and organic fluorine lattices as well as pigments, additives (UV stabilizers, flame retardants and thickening agents-thixotrops). The subject coatings may further be divided into two types, the primer coating which generally has no pigment, and the back coat which may contain pigment. Both primer and back coat form the interpenetrating polymer network during baking the coatings. The fabrics with both primer and back coat exhibit excellent water repellency, oil and stain resistance, antifungal and mechanical properties. The ratios of anionic urethane dispersions/acrylic lattices by weight can be from 95/5 to 5/95. The ratios of anionic urethane dispersions and acrylic lattices to organic fluorine lattices can be from 1/99 to 45/55. The ratios of anionic urethane dispersions, acrylic and fluorine lattices to melamine resins can be 99/1 to 80/20. The pigment concentration in the back coat can be from 5% to 30% and the antifungus agents can have a concentration range from 0.5% to 5% in both the primer and back coat. The concentration of UV stabilizer in the back coat can be from 0.2% to 5%. The amount of flame retardant in the back coat can be from 0.5% to 10%.

The "primer coat" thus contains preferably from about 5 weight percent to about 40 weight percent solids, more preferably from 5 to about 25 weight percent solids, and most preferably from about 10 to about 20 weight percent solids, and is of a viscosity such that relatively thorough penetration of the textile fabric occurs, this penetration optionally being facilitated by passage of treated fabric through pressure rollers, nip rollers, or equivalent devices during or after passage through the coating composition.

Preferably, the primer coat contains from 40–90%, more preferably 70–85% based on solids, of fluorochemical; from about 2% to about 20%, more preferably 4% to about 10%, and most preferably from about 4% to 8% of each of an acrylic latex and a polyurethane latex. Most preferably, the primer coat also contains an effective amount of a mildewcide, fungicide, or other biocidal agent, i.e. about 1 weight percent, and optionally fire retardants and other ingredients. Ammonia may be added for purposes of neutralization and/or increasing viscosity. Non-limiting examples of preferred and most preferred compositions are given below in Table 1.

TABLE 1

| Ingredient | Preferred % Range[1] | Most Preferred % |
|---|---|---|
| Zonyl ® 8412 | 70–90 | 83 |
| Hycar ® 1402 | 2–8 | 6.9 |
| PUR 962 | 2–8 | 6.7 |
| Zinplex | 0–2% | 0.7 |
| DM-50 | 0.01–5 | 0.8 |
| $NH_4OH$[2] | 0–5 | 1.5 |

[1]Based on solids
[2]As $NH_4OH$

The back coat is generally of higher solids content and contains relatively less fluorochemical. Two or more primer coats may be made in succession to increase water repellency, with or without addition of a back coat. However, use of a back coat is preferred when optimal water and stain repellancy is desired. The back coat also preferably contains a crosslinker, preferably a melamine/formaldehyde resin product or other resinous product containing active methylol groups. Preferred and most preferred compositions are given below in Table 2. Solids content generally lies between 30 and 60 weight percent, preferably between 40 and 50 weight percent, but may be adjusted within wide ranges to achieve the desired fabric pick up weight. When the solids content is lowered, the viscosity generally decreases. In order to raise the viscosity, an increase in the amount of thickener may be desired.

TABLE 2

| Ingredient | Preferred % Range[3] | Most Preferred % |
|---|---|---|
| Zonyl ® 8412 | 2–12 | 5.8 |
| Hycar ® 1402 | 20–80 | 49.6 |
| PUR 962 | 8–40 | 12.8 |
| Zinplex | 0–5 | 0.6 |
| DM-50 | 0–5 | 0.5 |
| $NH_4OH$ | 0–5 | 0.7 |
| Kronos ® 1050 | 0–15 | 6.2 |
| Calsan ® 50 | 0–20 | 14.1 |
| Firebrake ZB | 0–10 | 6.5 |
| Cyrez ® 933 | 0–5 | 0.5 |
| DEEFO ® 215 | 0–5 | 1.1 |
| Acrysol TT-935 | 0–5 | 1.6 |

[3]Based on solids.

The treated fabric of the subject invention has a number of advantageous and unique characteristics. It is highly water repellant, as well as stain resistant and sufficiently non-flammable to meet various flammability requirements. While highly water repellant, the fabric allows ready passage of water vapor, and is thus eminently suited for items such as boat covers, traditionally made of vinyl-coated fabrics. The vinyl-coated fabrics are substantially water vapor impermeable, and contribute to mildew formulation in boats using such covers, while prior art Latex-coated fabrics do not possess the requisite weather resistance, particularly with regard to photodegradation. The treated fabric has substantially the same hand, feel, texture, and drape of uncoated fabric, and thus can be manipulated by traditional manufacturing techniques as well as being aesthetically pleasing. The fabric is also considerably more resistant to tear and opening at needle holes, as well as having higher tensile strength. Importantly, the treated fabric may be transfer printed.

Having generally described this invention, a further understanding can be obtained by reference to certain specific examples which are provided herein for purposes of illustration only and are not intended to be limiting unless otherwise specified.

EXAMPLES

A textile treating primer coat was formulated as indicated as the most preferred composition in Table 1. The fluorochemical and acrylic latex dispersions (18.08% and 50% solids, respectively) were first mixed, following which ammonia (28%) was slowly added. The polyurethane latex, zinc ammonium carbonate, and only melamine resin are then added with stirring. The biocide, DM-50, is mixed with water in a weight ratio of 1:5 and slowly added, following which make-up water is added. The composition as formulated contains 14 weight percent solids, and was diluted 50:50 with water prior to use as a preferred primer coat.

A back coat was formulated in a manner similar to that used to prepare the primer coat, but with the ingredients used in the most preferred composition of Table 2. The ACRYSOL TT-935 was added by blending with water. The composition contained c.a. 40–55% solids, and is preferably used without dilution.

A polyester fabric having an areal weight of 8.2 oz/yd$^2$ (278 g/m$^2$) is passed through a diluted (~7% solids) primer coating bath and dried in an oven about 2 minutes at 320° F. (160° C.) . Solids take-up is 4–5% relative to the weight of uncoated fabric. The fabric thus produced is water repellant but does contain some "pinholes" when viewed by backlighting. The treated, primer-coated fabric is then back coated with the back coating as described previously, the excess coating removed with a knife blade down to about the height of the fabric weave, and cured in an oven (12 min, 320° F. (460° C.). The coated fabric is water repellant, capable of supporting a considerable column of water, and is stain and mildew resistant as well.

It will be appreciated by those skilled in the art that the amount of the copolymer composition, antimicrobial agent, fluorochemicals and additives may be varied depending on the desired performance of the coated fabrics. For example, fabric of tighter weave may require only a primary treatment or a primary treatment and one secondary treatment whereas an open weave fabric may require primary treatment and two or more secondary treatments. It will also be appreciated that the combination of the various components of the composition of the present invention may be varied to achieve the desired performance. For example, the solids content of the primary treatment composition, secondary composition, or both may be increased to reduce the overall number of treatments required.

What is claimed is:

1. A transfer-printable, water repellant and stain resistant synthetic textile fabric, comprising:

a) a synthetic textile fabric;

b) at least one fabric coating comprising, prior to drying on said fabric, b)i) an aqueous urethane latex;

b)ii) an aqueous acrylic latex;

b)iii) a fluorochemical; wherein the ratio of b)i) to b)ii) is from 90/10 to 10/90, and the ratio of b)i) and b)ii) to b)iii) is from about 1/99 to 45/55; and b)iv) a cross-linking agent; wherein the ratio of b)i), b)ii) and b)iii) to b)iv) is from about 99/1 to about 80/20.

2. The fabric of claim 1 wherein said coating prior to drying further comprises an effective amount of a biocide.

3. The fabric of claim 1 wherin said fabric comprises two coatings, a primer coating and a back coating applied to one side of said fabric only, said back coating containing a higher solids content and a lower fluorochemical content than said primer coating.

4. The fabric of claim 3 wherein said primer coating comprises, in weight percent based on solids, from 70–90% fluorochemical; from 2–8% acrylic latex; and from 2–8urethane latex.

5. The fabric of claim 4 wherein said back coating comprises, in weight percent based on solids, from 2–12% fluorochemical; from 20–80% acrylic latex; from 8–40% urethane latex; and from 0.1 to 5 weight percent crosslinkers.

6. The fabric of claim 2, wherein said primer coating comprises about 80–90% fluorochemical; from 4–8% acrylic latex; and from 4–8% urethane latex; and wherein said back coating comprises from 4–8% fluorochemical; from 40–60% acrylic latex; from 8–20% urethane latex and from 0.2 to 2% crosslinkers.

7. The fabric of claim 6 wherein said primer coating and said back coating each contain one or more biocides in a mildew-preventing effective amount.

8. The fabric of claim 7 wherein the amount of said primer coating when dry is from about 10 g to 20 g per square yard, and wherein said back coating, when dry, is from about 30 g to 45 g per square yard.

9. A transfer-printable, water repellant and stain resistant synthetic textile fabric, comprising:

a) a synthetic textile fabric; having deposited thereon:

b) a primer coat comprising the dried residue of an aqueous primer coating comprising from 5 weight percent to about 40 weight percent primer solids based on the weight of said aqueous primer coating, said primer solids comprising from about 2 weight percent to about 20 weight percent based on solids of an acrylic latex; from about 2 weight percent to about 20 weight percent based on solids of a polyurethane latex; and from about 40 weight percent to about 90 weight percent based on solids of fluorochemical; and optionally an effective amount of a crosslinker; and c) a back coat comprising the dried residue of an aqueous back coating applied to one side of said synthetic textile fabric, said back coating comprising from about 30 weight percent to about 60 weight percent back coating solids based on the weight of said aqueous back coating, said back coating solids comprising from about 20 weight percent to about 80 weight percent based on back coating solids of an acrylic latex; from about 8 weight percent to about 40 weight percent based on back coating solids of a urethane latex; from about 2 weight percent to about 12 weight percent based on back coating solids of fluorochemical; and from about 0.1 weight percent to about 5 weight percent based on back coating solids of crosslinker.

10. The fabric of claim 9, wherein said primer coating comprises about 80–90% fluorochemical; from 4–8% acrylic latex; and from 4–8% urethane latex; and wherein said back coating comprises from 4–8% fluorochemical; from 40–60% acrylic latex; from 8–20% urethane latex and from 0.2 to 2% crosslinker.

11. The fabric of claim 9 wherein said primer coating and said back coating each contain one or more biocides in a mildew-preventing effective amount.

12. The fabric of claim 9 wherein the amount of said primer coating when dry is from about 10 g to 20 g per square yard, and wherein said back coating, when dry, is from about 30 g to 45 g per square yard.

* * * * *

UNITED STATES PATENT AND TRADEMARK OFFICE

CERTIFICATE OF CORRECTION

PATENT NO. : 5,747,392

DATED : May 5, 1998

INVENTOR(S) : Han Xiong Hiao et al.

It is certified that error appears in the above-identified patent and that said Letters Patent is hereby corrected as shown below:

Column 16, Line 53, Claim 5, after "percent" delete "crosslinkers" and replace with --crosslinker--;

Column 16, Line 60, Claim 6, delete "crosslinkers" and replace with --crosslinker--;

Signed and Sealed this

Twenty-fourth Day of November, 1998

*Attest:*

Bruce Lehman

BRUCE LEHMAN

*Attesting Officer*

*Commissioner of Patents and Trademarks*